US008904875B2

(12) United States Patent
Lesjak et al.

(10) Patent No.: US 8,904,875 B2
(45) Date of Patent: Dec. 9, 2014

(54) PRESSURE SENSOR FOR AN ELECTRIC HOUSEHOLD APPLIANCE WITH ADDITIONAL SECURITY FUNCTION

(75) Inventors: Zvonko Lesjak, Tolmin (SI); Boris Velikonja, Tolmin (SI)

(73) Assignee: Illinois Tool Works Inc., Glenview, IL (US)

( * ) Notice: Subject to any disclaimer, the term of this patent is extended or adjusted under 35 U.S.C. 154(b) by 205 days.

(21) Appl. No.: 13/389,237

(22) PCT Filed: Aug. 6, 2010

(86) PCT No.: PCT/US2010/044647

§ 371 (c)(1),
(2), (4) Date: Feb. 6, 2012

(87) PCT Pub. No.: WO2011/017585

PCT Pub. Date: Feb. 10, 2011

(65) Prior Publication Data

US 2012/0131999 A1 May 31, 2012

(30) Foreign Application Priority Data

Aug. 7, 2009 (IT) ..... TO2009A0624

(51) Int. Cl.

| | |
|---|---|
| ***G01L 13/02*** | (2006.01) |
| ***G01L 15/00*** | (2006.01) |
| ***D06F 39/08*** | (2006.01) |
| ***A47L 15/42*** | (2006.01) |

(52) U.S. Cl.

CPC ..... *D06F 39/087* (2013.01); *A47L 15/4244* (2013.01)

USPC ..... 73/716; 73/736

(58) Field of Classification Search

USPC ..... 73/700–756

See application file for complete search history.

(56) References Cited

U.S. PATENT DOCUMENTS

| | | | |
|---|---|---|---|
| 3,392,741 | A | 7/1968 | Shinn |
| 3,436,502 | A | 4/1969 | Egli |
| 3,549,838 | A | 12/1970 | Waskowsky |
| 3,867,594 | A | 2/1975 | Graf et al. |

(Continued)

FOREIGN PATENT DOCUMENTS

| | | | |
|---|---|---|---|
| EP | 1621860 | A1 | 2/2006 |
| IT | TO2002A000245 | A1 | 9/2003 |
| WO | 2007034294 | A1 | 3/2007 |

OTHER PUBLICATIONS

Search Results for Italian Application No. TO2009A000624 dated Apr. 14, 2010.

(Continued)

*Primary Examiner* — Andre Allen

(74) *Attorney, Agent, or Firm* — Lowe Hauptman & Ham LLP

(57) ABSTRACT

A pressure sensor including: a casing fluid-tightly divided into a first and a second chamber by a deformable membrane and means for connecting the first chamber to the environment and the second chamber to a tank for an operative fluid of an electric household appliance for detecting the level thereof according to a deformation of the membrane upon the establishment of a differential pressure in the two chambers; wherein the membrane carries toward the first chamber a rigid disc operatively associated with a switch carried by the casing to either close or open the switch upon the deformation of the membrane beyond a predetermined entity.

22 Claims, 3 Drawing Sheets

(56) References Cited

U.S. PATENT DOCUMENTS

| | | | | |
|---|---|---|---|---|
| 4,671,116 | A | 6/1987 | Glennon et al. | |
| 4,827,095 | A * | 5/1989 | Clark et al. | 200/83 J |
| 7,180,285 | B2 | 2/2007 | Bindocci et al. | |
| 7,694,573 | B2 | 4/2010 | Giordano | |
| 2004/0255976 | A1 * | 12/2004 | DuHack et al. | 134/18 |
| 2004/0255977 | A1 * | 12/2004 | Slocum et al. | 134/18 |
| 2004/0255988 | A1 * | 12/2004 | DuHack et al. | 134/57 D |
| 2012/0017689 | A1 * | 1/2012 | Giordano et al. | 73/722 |
| 2013/0115106 | A1 * | 5/2013 | Fleischmann et al. | 417/36 |

OTHER PUBLICATIONS

ISR for PCT/US2010/044647 dated Nov. 16, 2010.

* cited by examiner

PRESSURE SENSOR FOR AN ELECTRIC HOUSEHOLD APPLIANCE WITH ADDITIONAL SECURITY FUNCTION

RELATED APPLICATIONS

The present application is national phase of PCT/US2010/044647 filed Aug. 6, 2010, and claims priority from Italian Application Number TO2009A000624 filed Aug. 7, 2009.

TECHNICAL FIELD

The present invention relates to a pressure sensor connectable in use to a sump or water collection tank of an electric household appliance, in particular a dishwasher machine or a washing machine, for detecting the water level in the tank or sump.

BACKGROUND ART

It is known from Italian patent application n° 2002A000245, an electrodynamic transducer, which may be used as a pressure sensor in an electric household appliance, and which comprises a casing accommodating a deformable membrane therein sensitive to the hydraulic pressure present on a side of the membrane connected in use, for example, to a tank of an electric household appliance containing a fluid, the level of which is intended to be measured; the membrane carries a ferromagnetic core, operatively connected to an inductor, and a movement thereof thus produces a variation of the resonance frequency of the inductor, which may be detected and processed by a specific processor, usually carried aboard the electric household appliance.

Such a type of sensor, if the liquid level (usually water) in the sump or tank increases over a given limit, is exposed to the risk of being flooded, because the liquid may overflow into the sensor along the tube which connects the sensor to the sump or tank. In order to avoid, or at least limit, this problem, a siphon device is normally arranged between sensor and sump or tank to intercept the liquid overflowing from the tank or sump.

Such a leakage interception device in some cases may not be sufficient to avoid the flooding of the sensor. Furthermore, even if the sensor outputs a signal to the processor of the electric household appliance which may be used to start the pump of the electric household appliance when a given threshold is exceeded, and thus empty the tank or sump before the flooding occurs, the intervention of the pump may be late; furthermore, such a signal threshold should be electronically calibrated, which may be a difficult, long and costly process.

DISCLOSURE OF INVENTION

It is an object of the present invention to provide a pressure sensor for an electric household appliance, in particular a dishwasher or a washing machine, provided with an additional safety function, e.g. to be able to immediately start the pump, or in all cases to empty the tank or sump or to activate a specific electric circuit, when a determined level is exceeded, and which is, at the same time, constructively simple, cost-effective, small in size, very reliable, and which does not alter the normal operation of the sensor for detecting the liquid level in the tank or sump of the electric household appliance.

The present invention thus relates to a pressure sensor for an electric household appliance, as defined in claim 1.

In particular, the pressure sensor according to the invention comprises a substantially rigid casing and a deformable membrane accommodated in the casing so as to fluid-tightly divide the interior of the same into a first and a second chamber; the casing is provided with means for connecting the first chamber to the atmospheric environment and the second chamber, by means of a tube full of air, to a sump or collection tank of an operative fluid (service liquid) of an electric household appliance for detecting the level thereof according to a deformation of the membrane upon the establishment of a differential pressure in the two chambers.

According to a first aspect of the invention, the membrane, carries a rigid disc at least on the side of the first chamber, made of electrically non-conductive material, which is operatively associated with a switch carried by the casing and adapted to be either closed or opened upon the deformation of the membrane beyond a predetermined entity or limit.

In particular, the disc is operatively associated with at least one pin eccentrically arranged with respect to a symmetry axis of the disc and which extends perpendicularly to the same, parallelly to the symmetry axis, through a through seat of the casing; at such a seat, the casing externally carries a cup-shaped support accommodating towards the pin and in a sliding manner along a direction parallel to the pin, an electrically conducting plate, which is operatively associated with the pin to be moved in use by the same upon the deformation of the membrane, the casing supporting on the side opposite to the pin, by means of a bottom wall thereof, a pair of electric contacts placed side-by-side facing the plate and isolated from each other and a threaded sleeve accommodating a threaded cap. Furthermore, elastic means are arranged within the cup-shaped support sandwiched between the plate and the threaded cap.

According to another aspect of the invention, the electric contacts of the pair of electric contacts insulated from each other and carried by the bottom wall of the cup-shaped support are arranged facing the electrically conducting plate and are integrated in a connector externally carried by the bottom wall of the cup-shaped support, integrally obtained in one piece with the bottom wall on the side opposite to the casing. Furthermore, the plate slidingly engages, at least with respective stretches of opposite perimetrical edges thereof, respective longitudinal slots obtained through a side wall of the cup-shaped support parallelly to the symmetry axis of the disc.

The elastic means are arranged so as to be preloaded to normally keep the plate in a first stroke-end position, abutting against respective ends of the slots, adjacent to an inlet opening of the cup-shaped support opposite to and facing the bottom wall of the same, in which position the plate is spaced apart from the pair of contacts facing it by a predetermined clearance; the slots of the cup-shaped support being of a length such that the plate may take, in use, under the bias of the pin and against the bias of the elastic means, a second stroke-end position, in which it abuts against the pair of contacts, electrically connecting them in short-circuit.

In this manner, during normal operation of the sensor, the membrane is gradually deformed as the service liquid level in the sump or tank of the electric household appliance increases, normally outputting a signal proportional to such a level to the control unit of the electric household appliance, the sensor carrying an electromagnetic transducer, carried in part by the membrane and in part by the casing, in axis with the disc.

If the level of liquid increases too much, however, the pin, pushed by the membrane, which is deformed beyond a given predetermined entity, opens or closes the switch; in the preferred embodiment, the switch is normally open and the membrane, beyond a given deformation, pushes the plate towards the contacts facing it, against the bias of elastic means, the rigidity of which may be adjusted by either partially screwing or unscrewing the cap threaded in the sleeve. Having overcome the predetermined rigidity of the elastic means and the liquid level in the tank or sump of the electric household appliance continuing to increase, the elastic means are deformed allowing the pin to make the plate slide until it abuts against the contacts arranged side-by-side, which are thus connected in short-circuit; such an action may produce the closing (or opening) of a service circuit of the electric household appliance connected to a connector carried by the cup-shaped support, e.g. constituted precisely by the feeding circuit of the pump or by other emptying means of the tank or sump, which is thus immediately emptied at the first occurrence of the risk of overflowing, thus avoiding the same.

Therefore, by virtue of the invention, without altering as a whole neither the structure of the sensor nor its normal operation, an additional safety function is obtained, consisting of an electric signal which is either activated or deactivated by the switch, in the case in point by the electric signal, which is activated by the connection in short-circuit of the electric contact and which may serve various purposes.

BRIEF DESCRIPTION OF THE DRAWINGS

Further features and advantages of the present invention will be apparent from the following description of two preferred embodiments thereof, exclusively provided by way of non-limitative example, with reference to the accompanying drawings, in which.

BEST MODE FOR CARRYING OUT THE INVENTION

Figure 1:
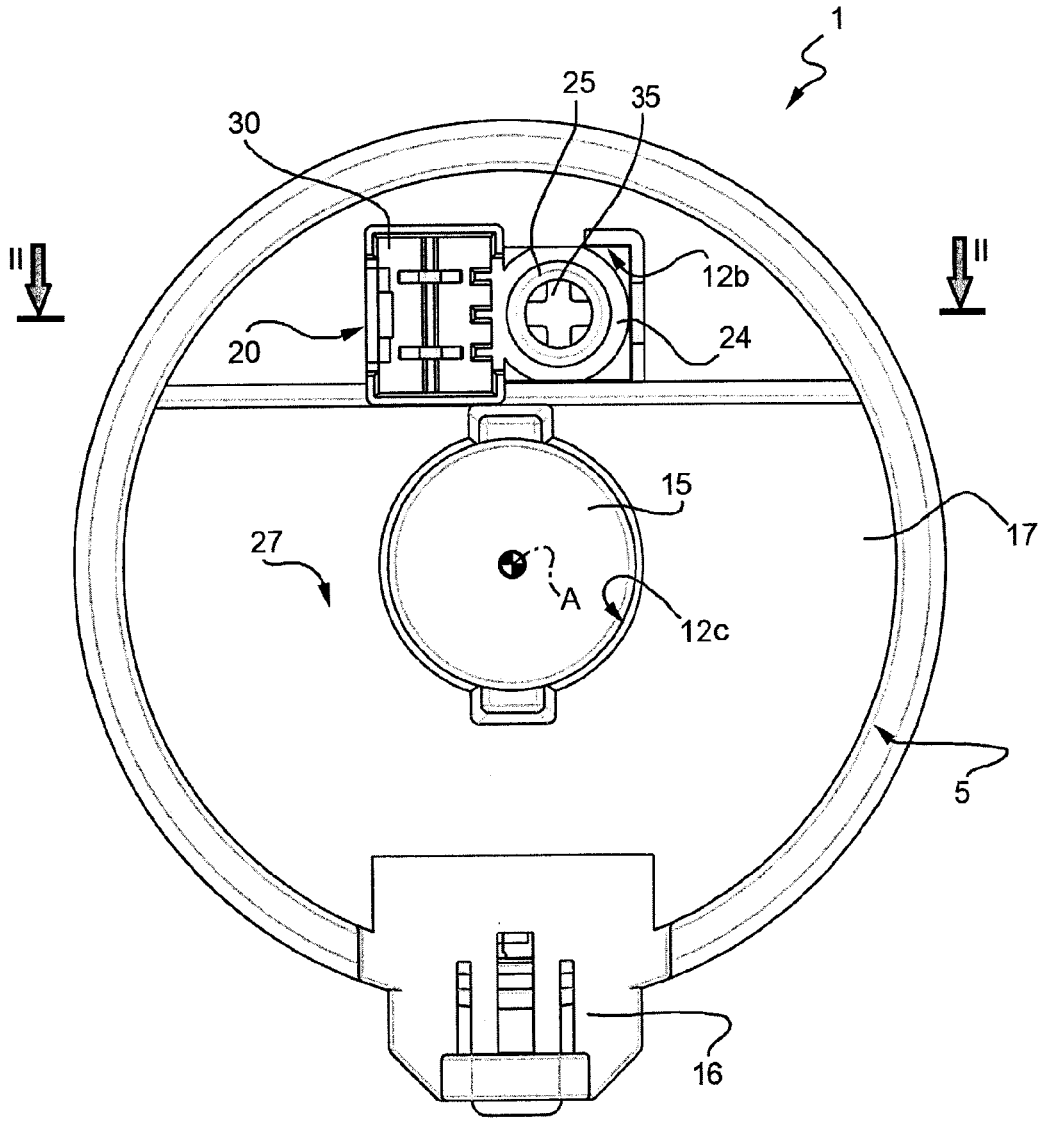
FIG. 1 diagrammatically shows a top plan view of a pressure sensor for an electric household appliance made according to the invention.
Figure 2:
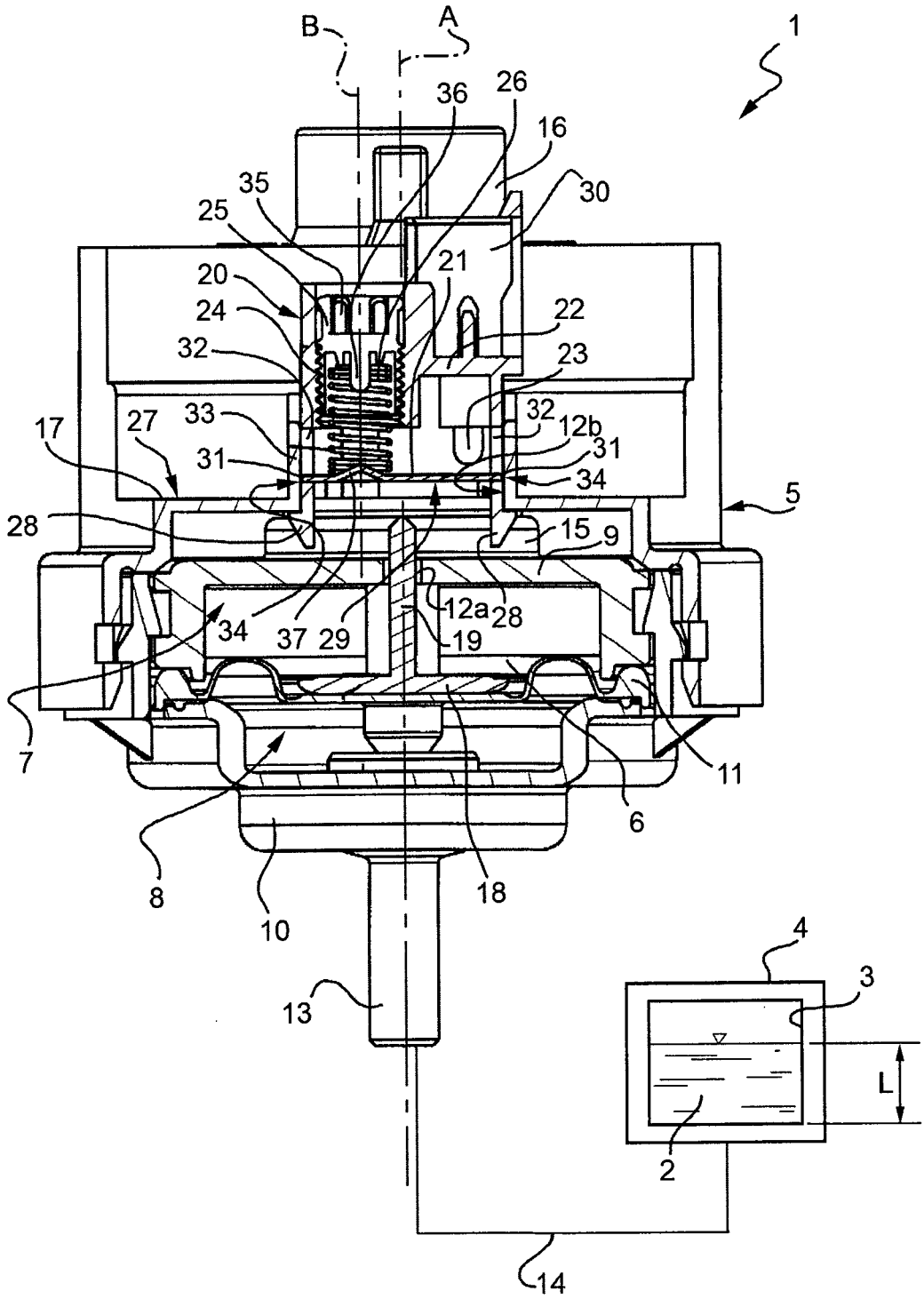
FIG. 2 diagrammatically shows a section elevation view taken along a plotting line II-II of the pressure sensor in FIG. 1.

With reference to FIGS. 1 and 2, numeral 1 indicates as a whole a pressure sensor for detecting in use the level L of a service liquid or fluid 2 in a tank or sump 3 of an electric household appliance 4, e.g. a washing machine or dishwasher.

The sensor 1 comprises a casing 5 and a deformable membrane 6 accommodated in the casing 5 in a manner known in itself so as to fluid-tightly divide at least a part of the same into a first chamber 7 and into a second chamber 8 (FIG. 2).

In particular, the casing 5 is formed by the snap-jointing, of known type, of a pair of half-shells 9,10 arranged with facing concavities and between which a peripheral edge 11 of the deformable membrane 6 is fluid-tightly pinched, which half-shells delimit the chambers 7 and 8, and of a third half-shell 17, mounted so as to overlap the half-shell 9, so as to contain it, and which snappingly engages the half-shell 10. Furthermore, the casing 5 is provided with means 12, 13 for respectively connecting the first chamber 7 with atmospheric environment and the second chamber 8, by means of a tube 14 normally full of air, with the sump or collection tank 3 of the operative service liquid or fluid 2 of the electric household appliance 4 to detect the level L in known manner according to a deformation of the membrane 6 consequent to the establishment of a differential pressure in the two chambers 7,8.

In the illustrated case in point, the interior of the chamber 8 is connected to the tube 14 by means of a nipple 13 integrally carried by half-shell 10, while the interior of the chamber 7 is open to the atmosphere by means of a series of perforations or seats 12*a*,12*b*,12*c* obtained through the half-shells 9 and 17. The sensor 1 is provided in known manner and which is not described in detail for the sake of simplicity, with an electrodynamic transducer 15, e.g. accommodated in a seat 12*c* of the half-shell 17, consisting of a ferromagnetic core, e.g. integrally carried by the membrane 6, operatively connected to an inductor and the relative movement of which, consequent to the deformations of the membrane 6, produces a variation of the resonance frequency of the inductor, which outputs a signal for the control unit of the electric household appliance 4, known and not shown for the sake of simplicity, which is picked up by a connector 16, known and carried on a peripheral edge of the most external upper half-shell 17 of the casing 5.

According to a configuration known in itself, the membrane 6 carries a round, rigid disc 18, at least on the side of the first chamber 7; according to an aspect of the invention, the rigid disc 18 is operatively associated with a switch 100 carried by the casing and adapted to be either closed or opened (according to the rest configuration thereof) upon the deformation of the membrane 6 beyond a predetermined entity or limit.

In particular, the switch 100 is carried by the third half-shell 17, accommodated in a through perforation or seat 12*b* of the same, and is, according to another aspect of the invention, actuated by a pin 19 operatively associated with the membrane 6 and carried by the half-shell 9 accommodated in a through seat 12*a* constituted by a through hole obtained through the half-shell 9.

According to the embodiment shown in FIG. 2, the disc 18 is made according to the invention of electrically non conducting material, e.g. of synthetic molded plastic material.

Anyway, the disc 18 has a symmetry axis A, which is also the general symmetry axis of the casing 5, the half-shell 9,10 and 17 being shaped so as to have symmetry axes coinciding with one another and with that of the disc 18.

According to an aspect of the invention, the rigid disc 18 integrally carries at least one single pin 19 arranged eccentrically with respect to axis A and which overhangingly extends perpendicularly from the disc 18, parallel to axis A, through the through-hole 12*a* in the casing 5, in the case in point made through the half-casing 9; at such a hole 12*a*, the casing 5 externally carries, in the case in point on the half-shell 17 in the manner shown, a cup-shaped support 20 slidingly accommodating, parallel to the pin 19 and towards the same, an electrically conducting plate 21, e.g. made of metallic material, operatively associated to the pin 19 to be, in the example shown intercepted in use by the same as a consequence of the deformation of the membrane 6, and consequently moved by the pin 19.

The cup-shaped support 20 further supports on the side opposite to the pin 19 and by means of a bottom wall 22 thereof, a pair of electric contacts 23 placed side-by-side (of which only one is visible in FIG. 2 precisely because the contacts are arranged side-by-side on a plane perpendicular to axis A), electrically isolated from each other and facing the plate 21, and a threaded sleeve 24 accommodating a threaded cap 25.

Finally, respective elastic means 26 are arranged within the cup-shaped support 20, sandwiched between the plate 21 and the threaded cap 25.

The pin 19 is integrally obtained in one piece with the rigid disc 18 made of the same electrically non-conducting material as the latter; similarly, the casing 5, with the half-shells 9,10 and 17, and the cup-shaped support 20 are also made of electrically non-conducting plastic material, and the cup-shaped element 20 is mounted so as to snap on a substantially flat first face 27 of the casing 5 (in the case in point, of the half-shell 17) arranged on the side of the first chamber 7, by means of at least one pair of elastically deformable teeth 28, which engage respective opposite edges of a through-perforation 12*b* of the first face 27, at which the cup-shaped support 20 is accommodated, in order to close the perforation itself, with an inlet opening 29 thereof facing the perforation 12*b* and the bottom wall 22 facing the same, on the side opposite to the inlet opening 29.

The electric contacts 23 are arranged facing the electrically conducting plate 21 and are integrated in a connector 30 externally carried by the bottom wall 22 of the cup-shaped support, integrally obtained in one piece with the bottom wall 22 and on the side opposite to the casing 5.

The plate 21 slidingly engages, at least with respective stretches of opposite perimetrical edges 31 thereof, respective longitudinal slots 32 obtained through a side wall 33 of the cup-shaped support 20 parallelly to the symmetry axis A of the disc 18. In combination, the elastic means 26 are arranged preloaded so as to normally keep the plate 21 in a first stroke-end position (shown in FIG. 2), abutting against respective ends 34 of the slots 32, adjacent to the inlet opening 29 of the cup-shaped support 20, in which position the plate 21 is spaced apart from the pair of contacts 23 facing it by a predetermined clearance; moreover, the slots 32 of the cup-shaped support 20 are of length such that the plate 21 may take, in use, under the bias of the pin 19 after having been intercepted by the same and against the bias of the elastic means 26, a second stroke-end position, not shown for the sake of simplicity, in which it abuts against the pair of contacts 23, electrically connecting them in short-circuit and thus closing, for example, an electric service circuit of the electric household appliance 4 connected in use to the connector 30, e.g. to produce the emptying of the sump or tank 3.

The threaded cap 25 is provided with gripping means 35 facing the outside of the casing 5 to allow to either screw or unscrew the same in a micrometric manner within the threaded sleeve 24 so as to accurately vary the preload of the elastic means 26. The latter consist of a helical spring arranged with a winding axis B thereof parallel to the contacts 23 and the symmetry axis A and parallel to a side wall 33 of the cup-shaped support 20; opposite ends of the helical spring 26 concentrically engage a receiving and guiding element 36 integrally carried by the threaded cap 25 and another receiving and guiding element carried by the plate 21, respectively, consisting in the case in point of a bossing 37 obtained on the plate 21 so as to present the convexity facing towards the spring 26 and the bottom wall 22 of the cup-shaped support 20.

Figure 3:
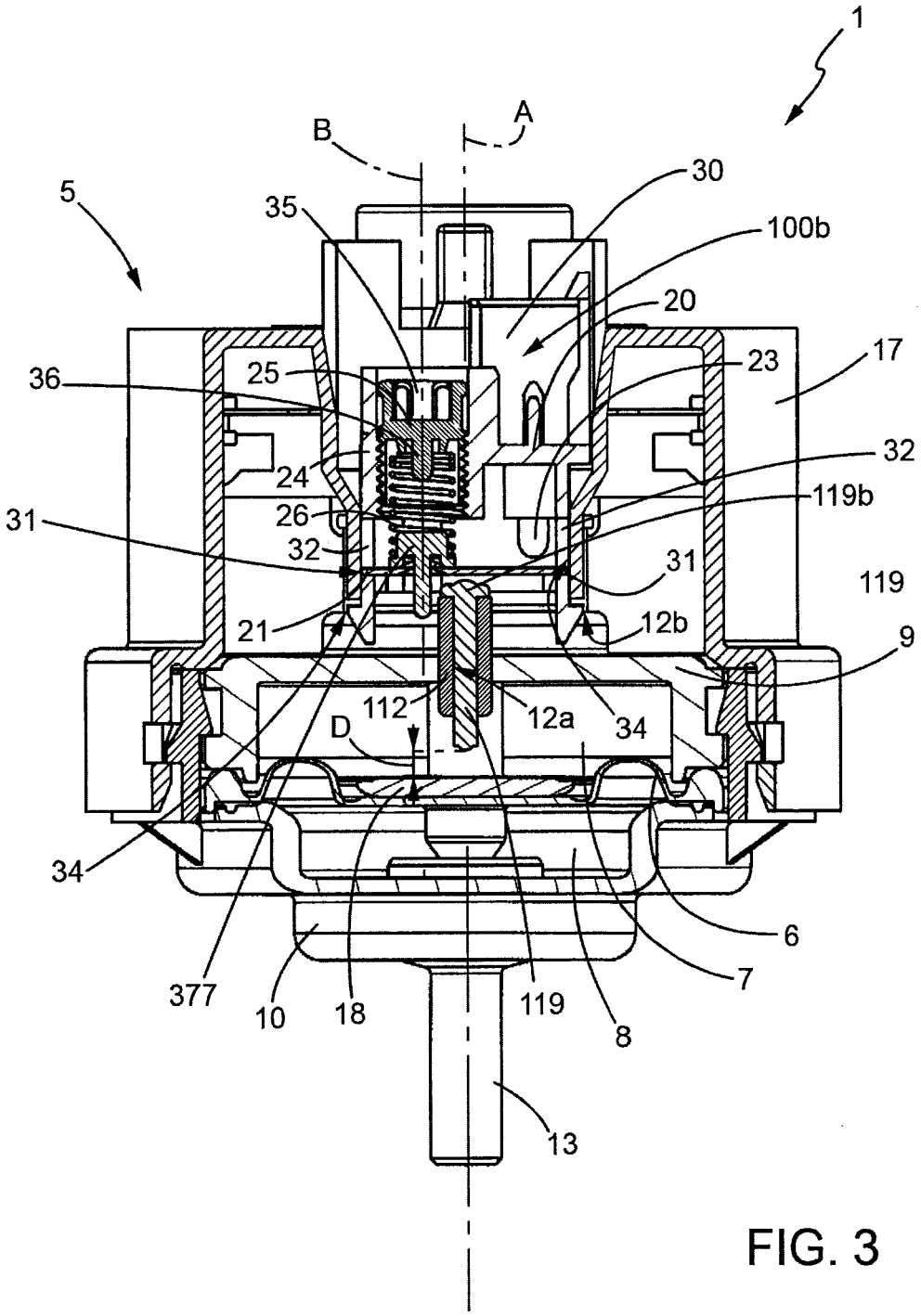
FIG. 3 diagrammatically shows a section elevation view taken along a plotting line II-II of a possible variant to the pressure sensor in FIG. 1.

FIG. 3, in which details similar or equal to those described above are indicated by the same reference numbers for the sake of simplicity, illustrates a variant of the sensor 1 shown in FIG. 2, which differs from the description above in that it comprises a switch 100*b* instead of a switch 100, similar to the previous one but operated in a slightly different manner.

In particular, the round, rigid disc 18 may be in this case non necessarily made of electrically non-conducting material and is operatively associated to a pin 119 made instead of electrically non conducting material, e.g. of a synthetic plastic material.

The pin 119 is supported by the half-shell 9 in the through seat 12*a*, which is defined by a sleeve 112 carried integrally by the half-shell 9, in a position facing the perforation 12*c* of the half-shell 17 and, like the pin 19 of the embodiment in FIG. 2 is integrally obtained with the disc 18, is arranged eccentrically with respect to the symmetry axis A of the disc 18 and extends perpendicularly to the same, parallel to axis A, through the seat 12*a*.

The pin 119 is carried by the casing 5, through the half-shell 9, so as to be arranged in contact with the plate 21 and, when the membrane 6 is not deformed, at a predetermined distance D from the rigid disc 18 (FIG. 3); for this purpose, it is provided with a mushroom-shaped head 119*b* which normally abuttingly cooperates with the sleeve 112.

On the contrary, in the case shown of switch 100 and pin 19, the latter is made and has a length such as to remain in use spaced apart from the plate 21, at a distance D from the same (FIG. 2), up to a predetermined deformation level of the membrane 6.

The remaining of the switch 100*b* is identical to the switch 100, except for the receiving and guiding element 21 of the spring 26, which consists of a bushing 377 driven through the plate 21, perpendicularly overhanging from the same and towards the cap 25.

In use, without altering the normal operation of the sensor 1, which is made by the transducer 15 positioned along the axis A, the sensor 1 is capable of either closing or opening the switch 100 or 100*b* by promptly opening (or closing) as a consequence a service circuit of the electric household appliance 4, not shown, connected thereto, e.g. to empty the sump or tank 3, as soon as the level L exceeds a certain predetermined threshold limit, which may be calibrated by means of the cap 25.

Indeed, having reached the threshold level L, the deformation of the membrane 6 is such that the pin 19 intercepts the plate 21 in the case of the embodiment in FIG. 2, or is reached and intercepted by the membrane 6 in the case of the embodiment in FIG. 3, pushing in both cases the plate 21 towards the contacts 23, against the bias of the spring 26. Having exceeded the rigidity of the spring 26, rigidity which is adjustable by turning the cap 25, the spring 26 yields and allows the plate 21 to come into contact and connect in short-circuit the contacts 23, obtaining the required effect; the limit beyond which the contacts 23 are connected in short-circuit is represented by the rigidity of the spring 26, which, by virtue of the described structure, is highly adjustable.

All the objectives of the invention are thus reached.

Obviously, whilst the illustrated switches 100 and 100*b* are of the normally open type, a switch of the normally closed type can be made, which is opened by the deformation of the membrane 6 beyond a given limit or entity.

The invention claimed is:

1. A pressure sensor comprising a casing and a deformable membrane accommodated in the casing so as to fluid-tightly divide the interior of the same into a first and a second chamber, the casing being provided with means for connecting the first chamber to the atmospheric environment and the second chamber, by means of a tube normally full of air, to a sump or collection tank of an operative fluid of an electric household appliance for detecting the level thereof according to a deformation of the membrane upon the establishment of a differential pressure in the two chambers; wherein the membrane carries a rigid disc at least on the side of the first chamber; characterized in that the rigid disc is operatively associated with a switch carried by the casing and adapted to be either closed or opened thereby upon the deformation of the membrane beyond a predetermined entity.

2. A sensor according to claim 1, characterized in that the rigid disc is operatively associated with at least one pin eccentrically arranged with respect to a symmetry axis of the disc and which extends perpendicularly to the same, parallelly to said axis, through a through seat of the casing; at such a seat, the casing externally carrying a cup-shaped support slidingly accommodating, parallelly to the pin and towards the same, an electrically conducting plate, which is operatively associated with the pin to be moved in use by the same upon the deformation of the membrane, the casing supporting on the side opposite to the pin, by means of a bottom wall thereof, a pair of electric contacts placed side-by-side facing the plate and isolated from each other, and a threaded sleeve accommodating a threaded cap, elastic means being arranged within the cup-shaped support sandwiched between the plate and the threaded cap.

3. A sensor according to claim 2, characterized in that said rigid disc is made of an electrically non-conducting material, said at least one pin being integrally obtained in one piece with the rigid disc made of the same electrically non-conducting material as the latter, and having a length such as to remain in use spaced apart from the plate up to a predetermined deformation level of the membrane.

4. A sensor according to claim 2, characterized in that said pin is made of an electrically non-conducting material and is carried by the casing arranged in contact with the plate and, with the membrane being undeformed, at a predetermined distance from the rigid disc of the deformable membrane.

5. A sensor according to claim 2, characterized in that said casing and cup-shaped support are made of a synthetic plastic material, the cup-shaped support being mounted so as to snap on a first, substantially flat face of the casing arranged on the side of the first chamber by means of at least one pair of elastically deformable teeth which engage respective opposite edges of a through perforation of the first face at which the cup-shaped support is accommodated, in order to close the perforation itself, with an inlet opening thereof facing the perforation and the bottom wall facing the same, on the side opposite to the inlet opening.

6. A sensor according to claim 2, characterized in that said electric contacts of said pair of electric contacts insulated from each other and carried by the bottom wall of the cup-shaped support are arranged facing the electrically conducting plate and are integrated in a connector externally carried by the bottom wall of the cup-shaped support, integrally obtained in one piece with the bottom wall and on the side opposite to the casing.

7. A sensor according to claim 2, characterized in that the plate slidingly engages, at least with respective stretches of opposite perimetrical edges thereof, respective longitudinal slots obtained through a side wall of the cup-shaped support parallelly to the symmetry axis of the plate.

8. A sensor according to claim 7, characterized in that said elastic means are arranged so as to be preloaded to normally keep the plate in a first stroke-end position, abutting against respective ends of the slots, adjacent to an inlet opening of the cup-shaped support opposite to and facing the bottom wall of the same, in which position the plate is spaced apart from the pair of contacts facing it, by a predetermined clearance; the slots of the cup-shaped support being of a length such that the plate may take, in use, under the bias of the pin and against the bias of the elastic means, a second stroke-end position, in which it abuts against the pair of contacts, electrically connecting them in short-circuit.

9. A sensor according to claim 8, characterized in that said threaded cap is provided with gripping means facing the outside of the casing to allow to either screw or unscrew the same in a micrometric manner within the threaded sleeve so as to accurately vary the preload of the elastic means.

10. A sensor according to claim 2, characterized in that said elastic means consist of a helical spring arranged with the winding axis thereof parallel to said contacts and to said symmetry axis of the disc and parallel to a side wall of the cup-shaped support; opposite ends of the helical spring concentrically engaging a receiving and guiding element integrally carried by the threaded cap and a second receiving and guiding element carried by the plate, respectively.

11. A sensor according to claim 1, characterized in that said casing consists of the snap-joint of first and second half-shells, arranged with the facing concavities and between which a peripheral edge of said deformable membrane is fluid-tightly pinched, and of a third half-shell mounted so as to overlap the first half-shell, so as to contain it, and which snappingly engages the other half-shell, all having a shape so as to have symmetry axes coinciding with one another and with that of said disc; said switch being carried by the third half-shell and being actuated by a pin operatively associated with the membrane and carried in a seat by the second half-shell.

12. A device, comprising:

a pressure sensor including:

a casing;

a deformable membrane accommodated in the casing so as to fluid-tightly divide the interior of the same into a first and a second chamber; and a rigid disk carried on the membrane at least on the side of the first chamber, wherein, the casing is configured such that the first chamber is in fluid communication with the atmospheric environment and the second chamber is in fluid communication via a conduit full of air to a sump or collection tank of an operative fluid of an electric household appliance to detect the level thereof according to a deformation of the membrane upon the establishment of a differential pressure in the two chambers, and wherein the rigid disc is operatively associated with a switch carried by the casing and adapted to be either closed or opened thereby upon the deformation of the membrane beyond a predetermined amount.

13. The device of claim 1, wherein:

the rigid disc is operatively associated with at least one pin eccentrically arranged with respect to a symmetry axis of the disc and which extends perpendicularly to the same, parallelly to said axis, through a through seat of the casing; at such a seat, the casing externally carrying a cup-shaped support slidingly accommodating, parallelly to the pin and towards the same, an electrically conducting plate, which is operatively associated with the pin to be moved in use by the same upon the deformation of the membrane, the casing supporting on the side opposite to the pin, by means of a bottom wall thereof, a pair of electric contacts placed side-by-side facing the plate and isolated from each other, and a threaded sleeve accommodating a threaded cap, elastic means being arranged within the cup-shaped support sandwiched between the plate and the threaded cap.

14. The device according to claim 13, wherein said rigid disc is made of an electrically non-conducting material, said at least one pin being integrally obtained in one piece with the rigid disc made of the same electrically non-conducting material as the latter, and having a length such as to remain in use spaced apart from the plate up to a predetermined deformation level of the membrane.

15. A device, comprising:

an electric household appliance selected from the group consisting of a dishwasher or a washing machine, including:

a pressure sensor including:

a casing;

a deformable membrane accommodated in the casing so as to fluid-tightly divide the interior of the same into a first and a second chamber; and a rigid disk carried on the membrane at least on the side of the first chamber; and a sump or a collection tank of an operative liquid of the electric household appliance, wherein, the casing is configured such that the first chamber is in fluid communication with the atmospheric environment and the second chamber is in fluid communication via a conduit full of air to the sump or the collection tank of the operative liquid of the electric household appliance, where the membrane is configured to deform upon the establishment of a differential pressure in the two chambers resulting from the level of the operative liquid of the electric household appliance in the sump or collection tank changing, and wherein the rigid disc is operatively associated with a switch carried by the casing and adapted to be either closed or opened thereby upon the deformation of the membrane beyond a predetermined amount, thereby indicating a level of the operative liquid of the electric household appliance thereof according to the deformation of the membrane.

16. The device of claim 15, wherein:

the rigid disc is operatively associated with at least one pin eccentrically arranged with respect to a symmetry axis of the disc and which extends perpendicularly to the same, parallelly to said axis, through a through seat of the casing; at such a seat, the casing externally carrying a cup-shaped support slidingly accommodating, parallelly to the pin and towards the same, an electrically conducting plate, which is operatively associated with the pin to be moved in use by the same upon the deformation of the membrane, the casing supporting on the side opposite to the pin, by means of a bottom wall thereof, a pair of electric contacts placed side-by-side facing the plate and isolated from each other, and a threaded sleeve accommodating a threaded cap, elastic means being arranged within the cup-shaped support sandwiched between the plate and the threaded cap.

17. A sensor according to claim 1, wherein the disk is made of electrically non-conducting material.

18. A sensor according to claim 1, wherein a surface of the disc abuts the membrane.

19. A device according to claim 12, wherein the disk is made of electrically non-conducting material.

20. A device according to claim 12, wherein a surface of the disc abuts the membrane.

21. A device according to claim 15, wherein the disk is made of electrically non-conducting material.

22. A device according to claim 15, wherein a surface of the disc abuts the membrane.

* * * * *